United States Patent [19]

Rotili

[11] Patent Number: 4,584,987

[45] Date of Patent: Apr. 29, 1986

[54] HEATING SYSTEM USING WOOD AS THE PRINCIPAL SOURCE OF ENERGY

[76] Inventor: Remo Rotili, 38, Roxton Crescent, Montreal West, Canada, H4X 1C6

[21] Appl. No.: 451,870

[22] Filed: Dec. 21, 1982

[30] Foreign Application Priority Data

Nov. 3, 1982 [CA] Canada ..... 414766

[51] Int. Cl.[4] ..... F24B 7/00

[52] U.S. Cl. ..... 126/132; 126/143; 165/174; 165/168; 237/8 R

[58] Field of Search ..... 126/132, 164, 143; 237/51, 8 R; 165/171, 174; 122/20 B

[56] References Cited

U.S. PATENT DOCUMENTS

| | | | |
|---|---|---|---|
| 4,050,626 | 9/1977 | Awalt, Jr. | 126/132 |
| 4,235,287 | 11/1980 | Kleine et al. | 165/174 |
| 4,257,557 | 3/1981 | Thomasma et al. | 126/132 |
| 4,406,402 | 9/1983 | Henriques | 126/132 |
| 4,453,532 | 6/1984 | Lindblom, Jr. | 126/132 |

FOREIGN PATENT DOCUMENTS

| | | | |
|---|---|---|---|
| 2333207 | 6/1977 | France | 126/132 |

*Primary Examiner*—Henry Bennett

*Attorney, Agent, or Firm*—Larson and Taylor

[57] ABSTRACT

A high efficiency fireplace with effective heat recovery capability for heating purposes and for heat storage. A fireplace boiler made of interconnected heat exchanger elements using sheet metal stamping technology, preferably corrugated metal stamped panels defining a plurality of water flow paths for circulating heat exchanging water. A wood burning domestic heating system using such an improved fireplace is also disclosed with suitable temperature control devices and thermal energy storage systems.

5 Claims, 18 Drawing Figures

HEATING SYSTEM USING WOOD AS THE PRINCIPAL SOURCE OF ENERGY

FIELD OF THE INVENTION

The present invention relates to heating systems and, in particular, to a domestic heating system using wood as the principal source of thermal energy.

BACKGROUND OF THE INVENTION

Energy, whatever its form, is the universal raw material and has become the lifeblood of modern man. Nonrenewable energy sources such as oil, gas, coal or uranium are fast running out and a practical solution to efficiently and economically tap our renewable energy resources is forever pressing.

Wood burning fireplaces or stoves are well known air heating devices dating back many years. In the days of Ben Franklin stand alone wood fireplaces or stoves provided the only source of heat. Because the rate of burning of wood is not a controllable process, the local air space being heated becomes too hot for comfort or otherwise too cold. Also such heating devices had no substantial thermal capacity and were an inconvenience in that constant feeding of fuel wood was required.

Modern day fireplaces are known to be inefficient or impractical as a means for extracting heat from a combustion chamber and for evenly distributing such thermal energy into the space to be heated in spite of numerous improvements in the field. Examples of improvements in fireplaces designed to improve upon the efficiency of such auxiliary heating devices are found in U.S. Pat. Nos. 1,432,538 (W. E. DE ARMOND); 4,019,677 (A. A. DOTSCHKAL); 4,025,043 (C. W. CLEER); and 4,050,626 (T. Y. AWALT). The fireplaces and the heating systems described in these patents invariably require a main source of heat which is different from and which is added to the wood burning process. This is no doubt due to the fact that people have become used to nearly perfect temperature regulation made possible with oil or gas fired furnace and electric furnace heating systems as a result of which fireplaces are at best an auxiliary source of heat even where wood is available as a cheap combustible.

I have found that it is possible to devise a practical, efficient and economical domestic heating system which uses a wood burning fireplace as the principal source of energy with no compromise in living comfort and minimum inconvenience to the user.

SUMMARY OF THE INVENTION

In accordance with my invention I provide, for use in a domestic wood burning fireplace in conjunction with an appropriate hot water circulation circuit means, a heat exchanger adapted to be installed within the fireplace and connected to the hot water circulation circuit means for heating the water therein. The heat exchanger comprises at least one heat exchanger element consisting of an inner wall, a coextensive and generally parallel outer wall welded to said inner wall along its periphery and inwardly thereof, and duct means for circulating water through the heat exchanger element. The inner wall and the outer wall are made of relatively thin sheet metal of steel at least one of which is embossed over substantially all of its extent to produce a plurality of uniformly distributed contact regions where the inner wall and the outer wall are welded together, and water flow path means in communication with the duct means. In certain cases, the contact regions are defined by parallel, equally spaced apart lands disposed between transversally curved ridges which define interconnected water flow paths. The heat exchanger according to my invention may take the form of a one piece heat exchanger extending along the two lateral sides and the back wall of the radiant section of the fireplace together with a convection section heat exchanger assembly which defines a smoke chamber directly above the radiant section heat exchanger assembly but I also contemplate the use of two separate heat exchanger assemblies mounted one on top of the other and suitably interconnected for water circulation.

I also provide a wood burning domestic heating system comprising the combination of a domestic wood burning fireplace, a fireplace hot water boiler as defined above, heat storage means of sufficient capacity in order to store enough energy for cold season domestic heating for numerous hours, a heat recovery system for dissipating thermal energy within the building being heated by said domestic heating system, a first hot water thermal energy transfer loop in circuit with the inlet and outlet pipe means of said fireplace hot water boiler and with said heat storage means for transferring thermal energy from said fireplace to said heat storage means, a second hot water thermal energy transfer loop for connecting the heat recovery system with the heat storage means, the first and the second hot water thermal energy transfer loops being interconnected for direct transfer of thermal energy from the first loop to the second loop.

My invention also comprises a novel damper operating mechanism and other features as will appear from the following description of preferred embodiments of my invention.

DETAILED DESCRIPTION OF PREFERRED EMBODIMENTS

Figure 2:
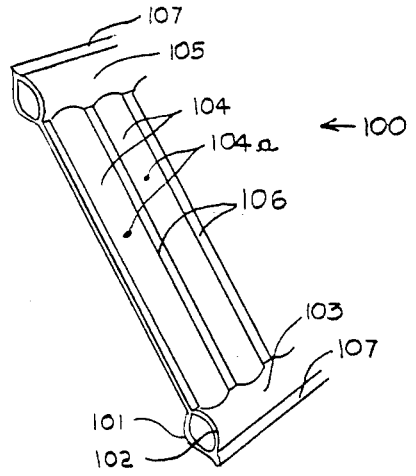
FIG. 2 is a partial perspective view of a metal stamped panel which may be used for constructing the assembly shown in FIG. 1.

With reference to FIGS. 1 to 4 of the accompanying drawings, the first embodiment of my invention is a fireplace boiler 110 consisting of a convection section heat exchanger 111 and a radiant section heat exchanger 112 where the two are joined together along line 138 to form a seal tight prefabricated fireplace assembly 110 resembling more or less a "boiler" in the form of a fireplace. The heat exchanger assembly 110 comprises an inlet pipe connection 113, two outlet pipe connections 114 and 115, a front operated damper 127 and a framed opening 140 defining the fireplace opening onto which suitable doors such as 141*a* and 141*b* are suitably hinged.

The convection section heat exchanger 111 consists of three metal stamped panels 122, 123 and 124 each of which is made of metal stamped panels such as shown in FIG. 2 at reference numeral 100. Combustion seal plates 121*a* and 121*b* are suitably welded to form a seal tight assembly against the products of combustion. The metal stamped panels 122, 123 and 124 are interconnected by assorted pipes and fittings 116*a*, 116*b*, 116*c*, 116*d*, 114 and 115 such that the quantity of water flowing in each vertical flow circuit in any one panel is approximately equal. The flow is from the bottom connection or inlet pipe 113 to the upper connection or outlet pipe 114 which is the natural flow of water as it is heated. As better seen in FIG. 3, panels 122, 123 and 124 are geometrically arranged to provide maximum heat transfer by creating turbulence in the combustion gases as they progress towards the smoke shelf 150 of the chimney and this provides a proper elimination of the smoke through the chimney. The turbulence is achieved by angulating panels 122, 123 and 124 approximately at 45 degrees with respect to the vertical and by constricting the passage of the combustion gases between panels 122 and 124, the clearance being between 5 and 9 cm across.

With particular reference to FIG. 2, a first preferred form of panel for the heat exchangers in accordance with my invention consists of an inner wall 101 and an outer wall 102 which are coextensive and parallel to one another. They are welded together along their periphery and inwardly of their periphery and each wall is made of a relatively thin sheet metal of steel. In practice, 12 gage sheet metal has been found quite adequate for this purpose. These two sheet metal stampings are juxtaposed and resistance welded in a face to face relationship in order to define water passages for circulating water through the heat exchanger element. The embossing defines a plurality of essentially uniformly distributed contact regions or lands 106 and transversally curved ridges 104 which define the interconnected water flow paths through which the hot water circulates. Although it is within my invention to provide a flat outer wall (not shown) in conjunction with an embossed inner wall 101, the use of double embossing is generally preferred as it provides a greater hot water capacity and better heat exchanging.

Embossed inner wall 101 and outer wall 102 also define a bottom header 103 and a top, horizontal header 105 in communication with the vertically extending water flow paths 104*a*. I prefer to use fusion welding techniques for joining together inner wall 101 and outer wall 102, welding occurring along lands 106 and along the upper and lower margins 107 which extend along headers 105 and 103 respectively. Pipe fittings can be suitably welded or brazed to the horizontally extending headers 103 and 105. Diagonally opposite pipe connections are preferred since it results in approximately equal flow in vertical flow circuits 104*a*. Plugs (not shown) are welded at the ends of headers 103 and 105 where pipe connections are not required.

In practice, using 12 gage carbon steel sheet metal, the heat exchanger panel 100 as described above has been found to be capable of withstanding working pressures in excess of 690 kpa.

Figure 1:
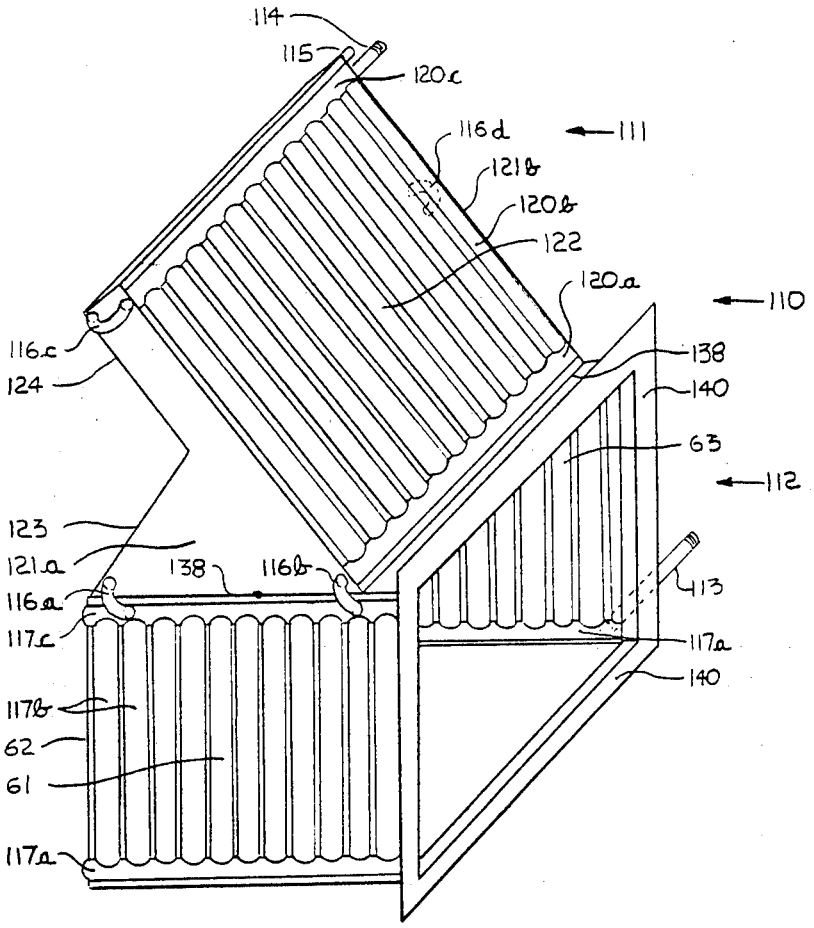
FIG. 1 is a perspective view of a fireplace boiler in accordance with this invention.

With particular reference to FIG. 1, the radiant section 112 of the heat exchanger assembly 110 comprises three heat exchanging panels 61, 62 and 63 respectively defining the left lateral side, the back and the right lateral side of the fireplace boiler 110. The flow of water is from the horizontal perimeter bottom header 117*a* to the horizontal top header 117*c* via the vertically extending water flow paths 117*b*. Top header 117*c* is connected to the bottom header 120*a* of panel 122 using return bend 116*b*. Top header 117*c* is also connected to bottom header 125*a* of panel 123 (see FIG. 3) using return bend 116*a*. Top header 125*c* of panel 123 is connected to bottom header 126*a* of panel 124 using return bend 116*d*. The utmost top header 126*c* of panel 124 is connected to header 120*c* of panel 122 using return bend 116*c*. Fitting 114 which constitutes the outlet pipe is welded to the top header 120*c* of panel 122 to result in a single outlet connection. Fitting 115 is welded to header 126*c* which may be used to install a temperature sensing well. Open ended headers not requiring fittings are plugged.

Figure 3:
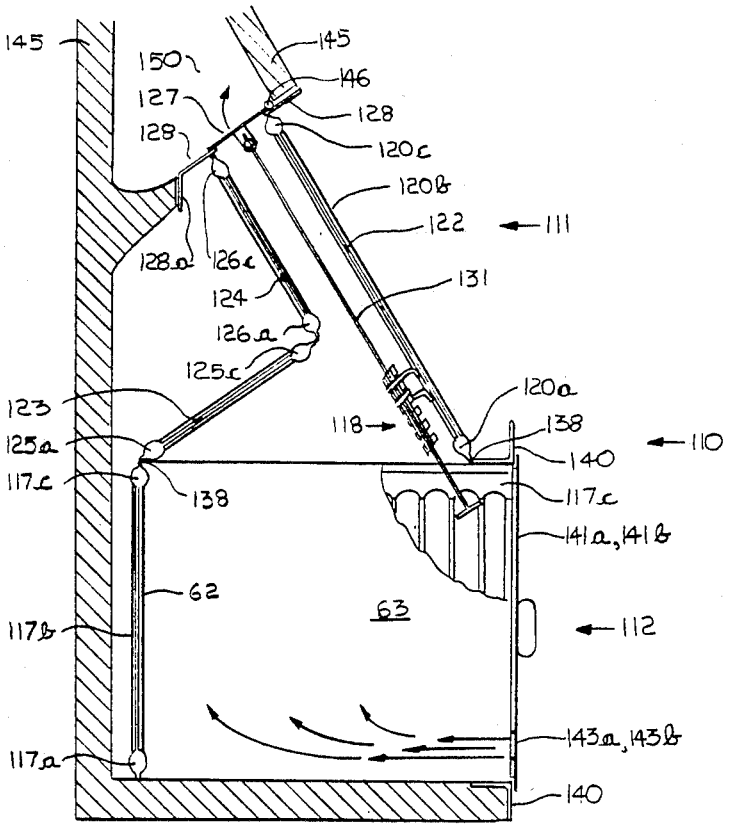
FIG. 3 is a cross-sectional elevational view taken through a domestic wood burning fireplace in accordance with this invention.
Figure 5:
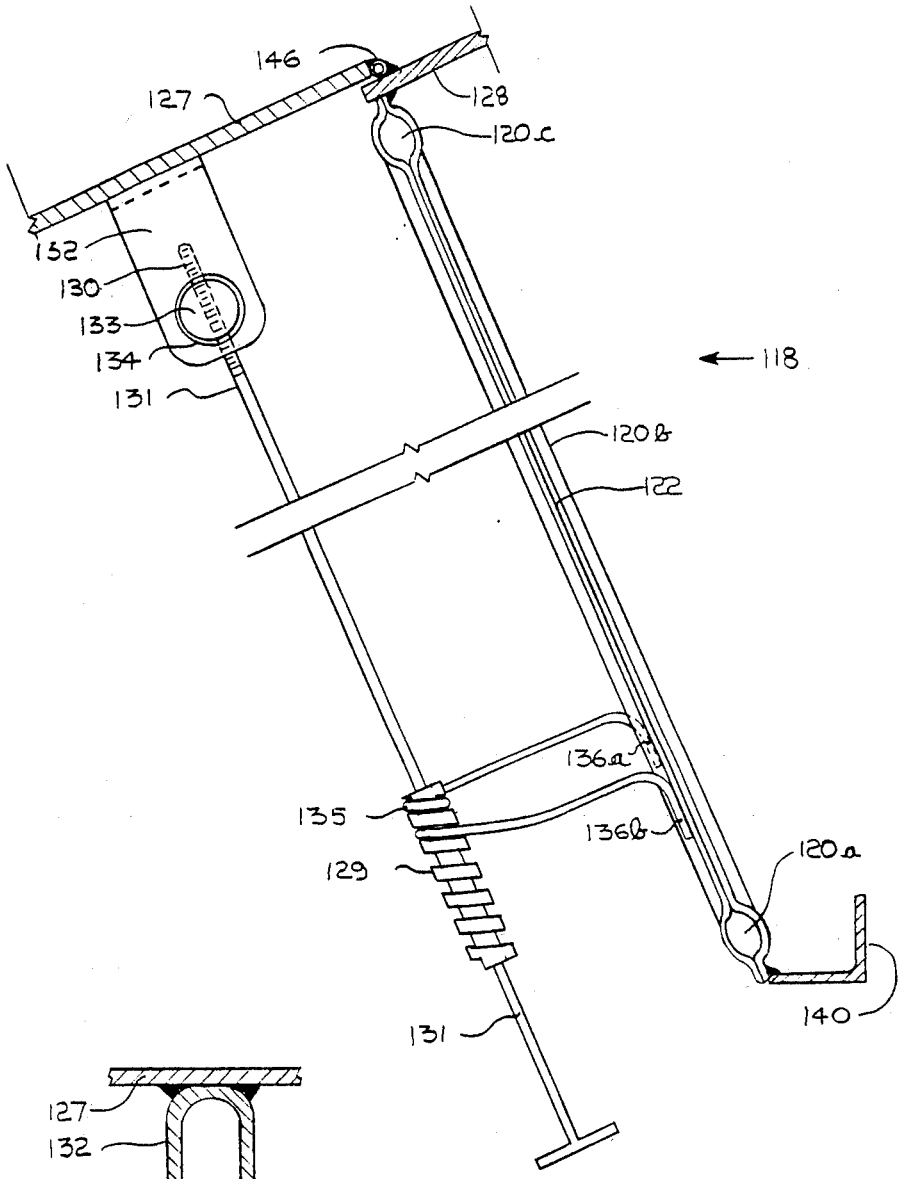
FIG. 5 is an enlarged cross-sectional view of a portion of the fireplace seen in FIG. 3 with particular reference to a damper operating mechanism.
Figure 6:
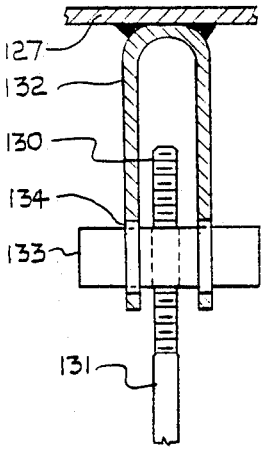
FIG. 6 is a cross-sectional view of the upper end of the damper operating mechanism of FIG. 5.

Also integral to the fireplace boiler assembly 110 is damper 127 and damper operating mechanism 118 shown in FIGS. 3, 5 and 6. Damper 127 is suitably hinged to collar 128 at 146. Collar 128 is welded along the top perimeter of the convection section heat exchanger 111 extending approximately 10 cm on the lateral sides and along the top edge of panel 122. Along the edge of panel 124 collar 128 is angled downwardly to form a vertical edge 128*a*. The purpose of vertical edge 128*a* is to support the horizontal forces of the brick structure 145 during the construction phase of the smoke shelf 150. The damper operating mechanism 118, as shown in FIGS. 5 and 6 consists of a "U" shaped bracket 132 with two circular holes 134 punched at the ends, an operating rod 131 threaded at the damper end at 130, a female threaded pin 133, male screw or worm 129 and female open screw 135. Pin 133 is inserted into holes 134 of bracket 132 and is designed to compensate for rotary motion as the damper opens. Operating rod 131 is thus screwed into pin 133. Pin 133 is sufficiently long such that it can not be removed once rod 131 is in place. Worm 129 engages with its counterpart female screw 135. Female screw 135 is made of a steel rod shaped in the configuration shown in FIG. 5. Screw rod 135 is welded to the underside of panel 122 at 136*a* and 136*b* for support. The helical brace 135 is such that there is sufficient tolerance and flexibility to compensate for side or lateral movements as damper 127 travels on its arc.

The damper operating mechanism 118 translates continuous rotary motion into opening and closing of damper 127. The design basis for the operation is that worm 129 has about one thread per 2.5 cm and screw 130 has about twenty threads per 2.5 cm so that (to use an example) as rod 131 is continuously turned screw 129 advance 10 cm enough to open the damper whereas screw 130 advances only 0.5 cm. With this design the operating handle withdraws into the convection section assembly 111 as the damper opens. The visibility or non visibility gives the user a visual indication on the status of the damper 127.

Frame 140 is suitably welded to the foreward edges of the radiant section heat exchanger 112 and along line 138 of header 120*a* of panel 122. Air tight doors 141*a* and 141*b* are suitably hinged to frame 140 at 142*a* and 142*b*. The air tight doors 141*a* and 141*b* basically comprise a high temperature glass and two air openings 143*a* and 143*b* where the combustion air intake may be adjusted using slide gates 144*a* and 144*b*. Doors 141*a* and 141*b* introduce combustion air through openings 143*a* and 143*b* horizontally directly in the firewood as controlled by gates 144*a* and 144*b*. The stack draft provides the motive power to more or less "blow" the air in the fire. Introducing air horizontally greatly increases the rate of combustion and therefore the energy output of the fireplace boiler assembly. In the design shown in FIG. 4 air is taken from within the house. A method of introducing controlled combustion air from outside and horizontally to the fire will be described later and shown in FIGS. 9 and 10.

Figure 4:
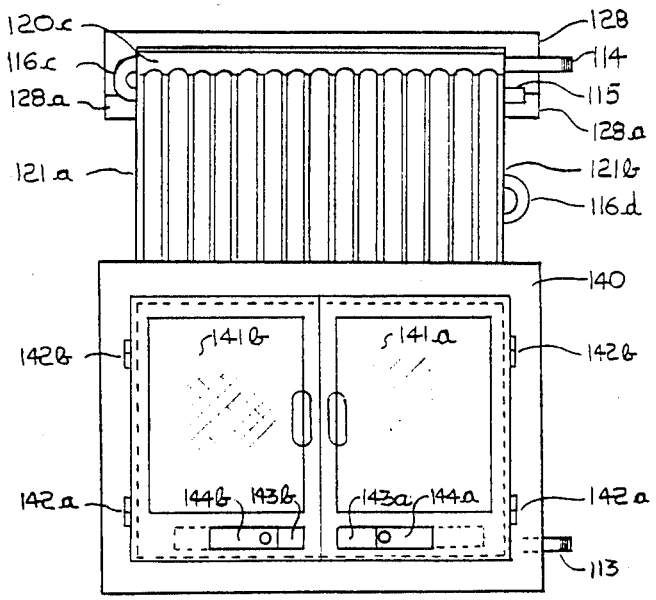
FIG. 4 is a front elevational view of the fireplace seen in FIG. 3.

Fireplace assembly 110 shown in FIGS. 1, 3 and 4 without an air tight door should have a net conversion efficiency of about 33% of which about 27% is transmitted directly to the circulation water and approximately 6% is transmitted to the room itself by radiation and convection heating according to the tests that I made. The installation of glass or steel air tight doors 141*a* and 141*b* suitably hinged to frame 140 increases the net conversion efficiency to over 45%. This is because in an open type fireplace the large volume of air being drawn up the chimney actually cools the fire and the heat exchanger surfaces; whereas air tight doors 141*a* and 141*b* actually "bottles" in the heat.

The convection section heat exchanger 111 just described and shown in FIGS. 1, 3 and 4 constitutes a major improvement over other forms of heat exchangers such as, for example, tube bundles in that the heat exchanger panels themselves form a seal tight assembly against the combustion gases, they provide a large surface area for the heat exchange, and the exchanger surface can be cleaned through the fireplace opening using a wire brush which is a very simple operation.

Figure 7:
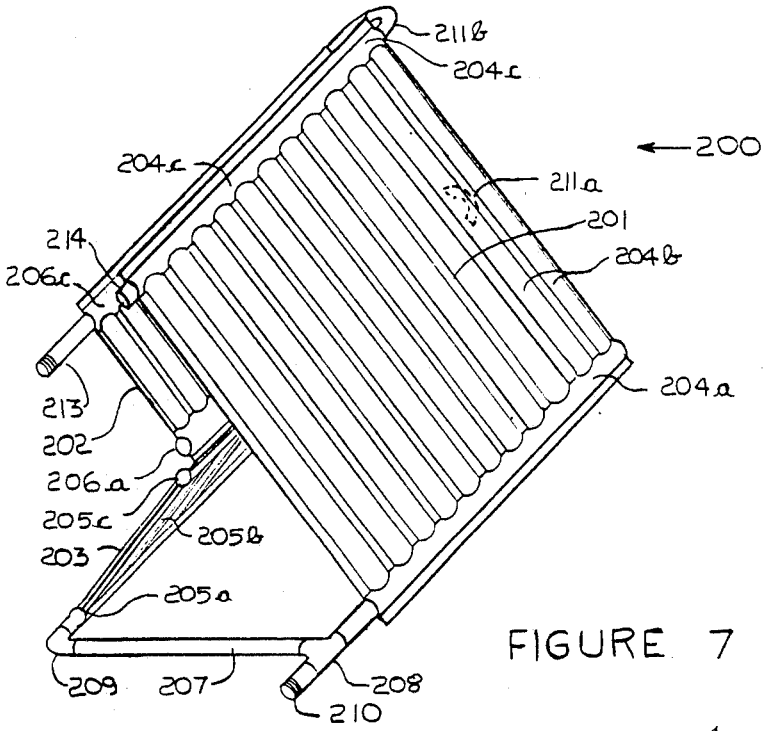
FIG. 7 is a perspective view of a convection section heat exchanger assembly which constitutes an alternative embodiment of my invention.
Figure 8:
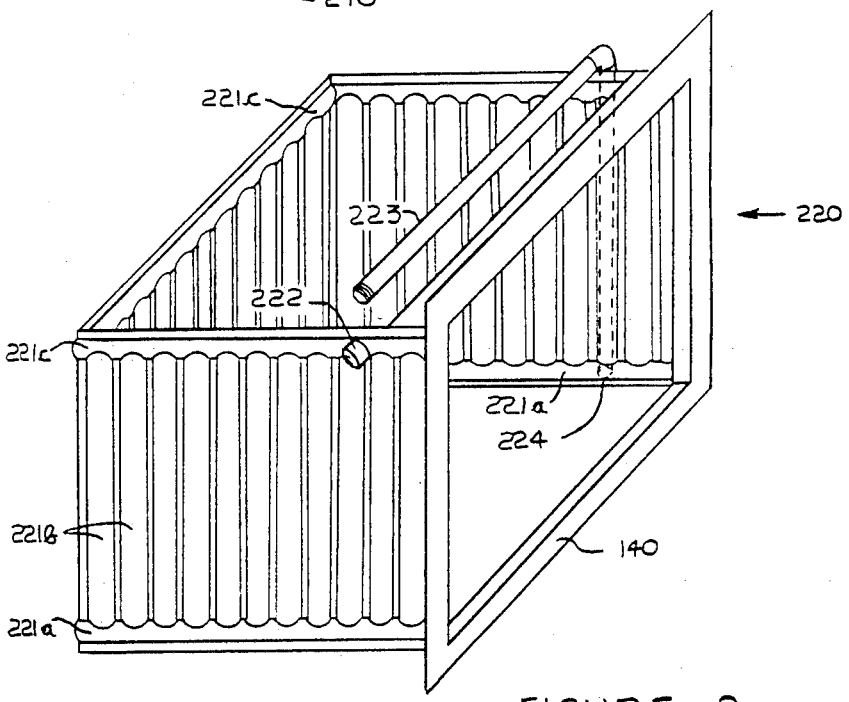
FIG. 8 is a perspective view of a radiant section heat exchanger assembly compatible with the convection section heat exchanger assembly of FIG. 7.

FIGS. 7 and 8 show a second embodiment of the invention wherein the convection section heat exchanger 200 is a separate unit which can be removed out of the fireplace through a side access door (not shown). Radiant section heat exchanger 220 may be removed through the fireplace opening for servicing. The convection section heat exchanger 200 is basically the same configuration as that shown in FIGS. 1, 3 and 4. The differences are that it is physically separated from the radiant section heat exchanger, its panels 201, 202 and 203 are interconnected differently and the side seal plates may be omitted if it is desired to clean assembly 200 through the above noted side access door. In this type of fireplace construction the damper would be one of conventional design (not shown).

Hot water enters at fitting 210 and is diverted by tee fitting 208 to header 204*a* of panel 201 and also header 205*a* of panel 203 by means of fittings 207 and 209. Flow between panels 203 and 202 is series connected by means of return bend 211*a* which connects top headers 205*c* of panel 203 to bottom header 206*a* of panel 202. The two top headers 204*c* and 206*c* of panels 201 and 202 are interconnected by return bend 211*b*. Outlet pipe 213 is suitably connected to header 206*c* of panel 202. Header 206*c* carries the sum of flow of water of panels 201 and 202. The panel ends which do not receive fitting are suitably blanketed by welding.

Referring now to FIG. 8, a radiant section heat exchanger 220 is shown similar in construction to the radiant section heat exchanger shown in FIGS. 1, 3 and 4. However, it is physically separated from the convection section heat exchanger and pipe connections 222 and 223 are brought forward to the side of the access door in the fireplace sidewall (not shown). Fitting 222 is suitably welded to top header 221*c* and fitting 223 is suitably connected to bottom header 221*a* at 224. The diagonality of the inlets 223, 224 and of the outlet 222 results in approximately equal flows in vertical flow circuits 221*b*. The radiant section heat exchanger 220 shown in FIG. 8 would be of considerable value to the retrofit market for use in pre-existing fireplaces; the minimum installation using a radiant section heat exchanger 220 without a convection section unit as at 200. Normally, the radiant section heat exchanger 220 will be delivered with an air tight door (not shown) on frame 140.

Figure 9:
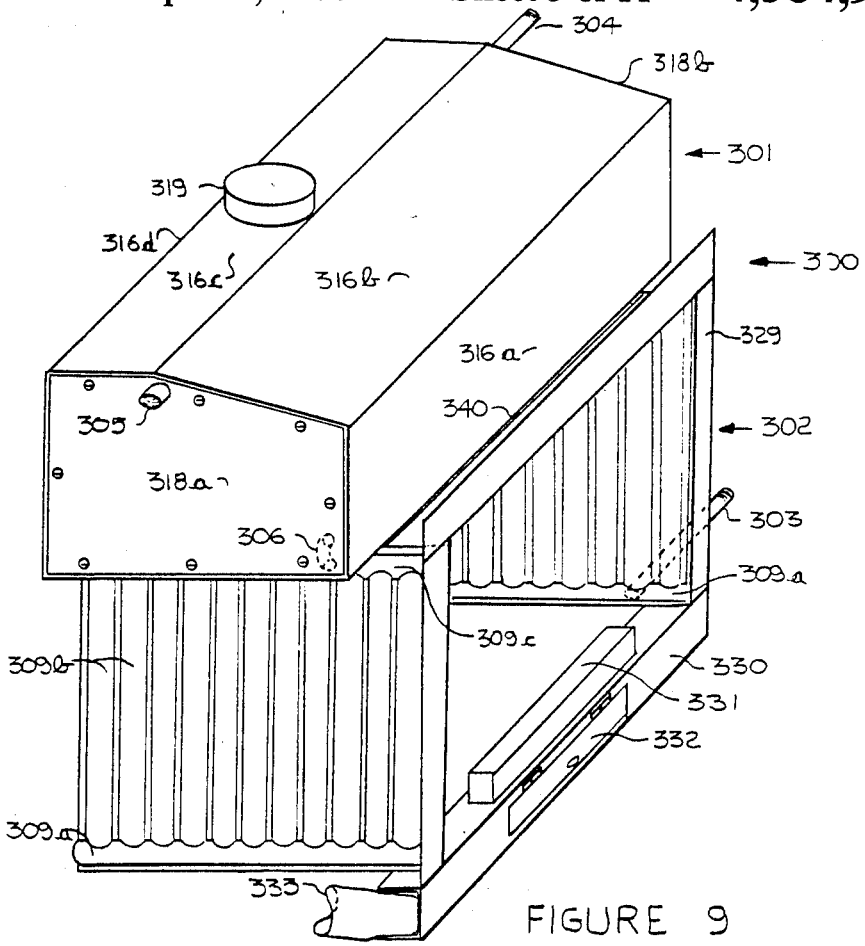
FIG. 9 is a perspective view of a third embodiment of a heat exchanger assembly according to my invention.
Figure 10:
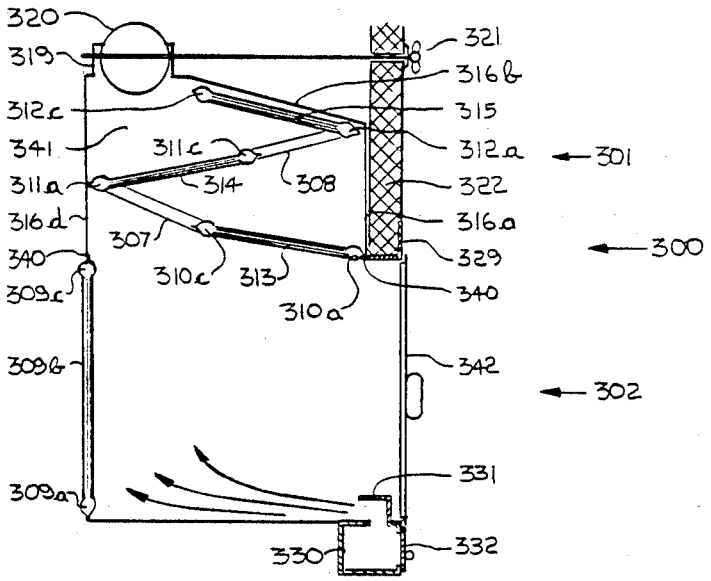
FIG. 10 is a cross-sectional view of a fireplace using the assembly shown in FIG. 9.

An alternate embodiment of the fireplace boiler assembly according to my invention is shown in FIGS. 9 and 10. The illustrated fireplace boiler assembly 300 is similar in concept to assembly 110 of FIGS. 1, 3 and 4 in that it consists of a radiant section heat exchanger 302 and a convection section heat exchanger 301 joined together along line 340 to result in a seal tight assembly. The convection section heat exchanger 301 and the manner in which combustion air is introduced by distribution header 330, however, are of a different design.

The convection section heat exchanger 301 consists of three panel heat exchangers 313, 314 and 315; a box type combustion gas tight enclosure for the panels consisting of four contiguous plates 316*a*, 316*b*, 316*c* and 316*d*; two removable end plates 318*a* and 318*b*; chimney connecting collar 319 on top plate 316*c*; damper 320; return bends 306, 307 and 308 and two outlet pipes 304 and 305. This construction resembling a box type stove, has several features not available on the construction shown in FIG. 1. Collar 319 permits the use of prefabricated chimneys. The height of the convection section 301 is considerably smaller. Thirdly, the heat exchanger panels 313, 314 and 315 are considerably more angulated (approximately 15° off of the horizontal) which results in a highly efficient heat exchange.

The end plates 318*a* and 318*b* are provided for the purpose of removing ashes which may accumulate in smoke chamber 341. On the combustion side of end plates 318*a* and 318*b* is a high temperature glass fibre mat (such as that sold by Fiberglass Canada under designation No. 381-2510-055 rated at 510° C.) which serves as a seal. When the end plates are bolted in place the glass fiber compresses and seals against the products of combustion.

Referring now to the radiant section heat exchanger 302, it is similar in construction to that shown at 220 in FIG. 8. One difference is that in assembly 302, a combustion air header 330 and deflector 331 is installed such that combustion air (from outside or inside) is introduced horizontally into the heart of the fireplace. Outside air can be suitably introduced by connecting an outside air duct 333 at either end of air header 330 and blocking the opposite end. Inside air can be introduced by opening door 332 which which is suitably hinged to air header 330. The combustion air header 330 also forms the bottom face of frame 329. An air tight door 342 suitably hinged to frame 329 may be used to advantage; however, unlike the construction shown in FIG. 4, combustion air vents built into the door are not required.

The thermal exchange fluid enters at the bottom of the radiant section heat exchanger 302 at pipe 303, which connects to the horizontal bottom header 309*a*. Horizontal header 309*a* feeds the vertically extending flow circuits 309*b* which in turn lead to top horizontal header 309*c*. Return bend 306 connects top header 309*c* with bottom header 310*a* of panel 313. Return bend 307 (diagonally opposite return bend 306) flow connects top header 310*c* of panel 313 to bottom header 311*a* of panel 314. Return bend 308 (opposite return bend 307) flow connects top header 311*c* of panel 314 to bottom header 312*a* of panel 315. On top header 312*c* opposite return bend 308 is connected the main outlet pipe 304. At the opposite end of header 312*c* is fitting 305 which may be used for such purposes as installing temperature sensors. The fireplace boiler assembly 300 can be suitably finished to suit the aesthetic requirements of the user. The top of frame 329 is an angle iron which may be used to support the weight of building materials 322 such as bricks, stones or the like.

Figure 11:
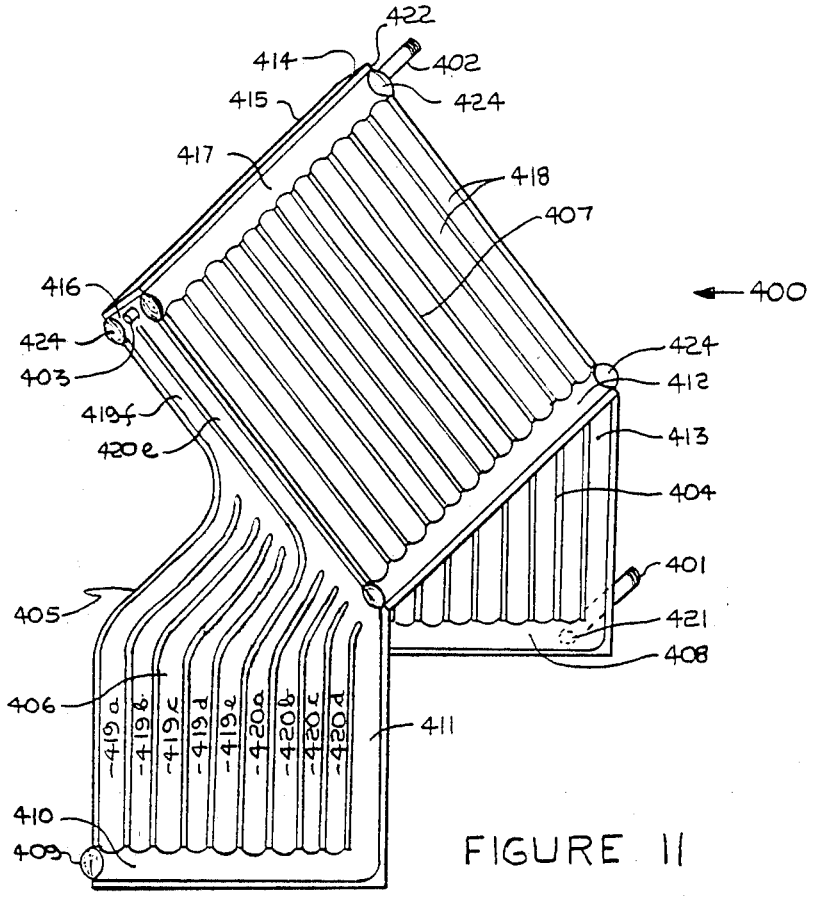
FIG. 11 is a further embodiment of the fireplace boiler according to my invention.

Referring now to FIG. 11, a fireplace boiler assembly 400 is shown where in the convection section heat exchanger and the radiant section heat exchanger are integrated into one assembly. It basically consists of four pre-assembled panel heat exchangers 404, 405, 406 and 407 welded together in the illustrated configuration; a continuous bottom header contouring the assembly 400 and defined by individual headers 408, 409, 410, 411, 412 and 413; a continuous top header defined by individual headers 414, 415, 416 and 417; a plurality of vertically extending serpentine 419*a* to 420*e* and straight flow circuits interconnecting the continuous bottom and top headers; inlet pipe 401; outlet pipe 402; outlet connection 403; and a stamped corner plate 424 for interconnecting the individual headers. Also included with assembly 400, but not shown for clarity, is a supporting collar for firebricks, damper and damper operating mechanism similar to those shown in FIGS. 3 to 6. Also included with assembly 400, but not shown for clarity, is a frame outlining the fireplace opening, an air tight door(s) and a combustion air header which introduces air horizontally towards the burning wood, similar to the construction shown in FIGS. 9 and 10 or FIG. 3.

Heat exchanger panel 407 is rectangular and is similar to the construction shown in FIG. 1 having a bottom header, a top header and a plurality of stamped flow circuits connecting the two headers. Panel 405 is considerably longer than panel 407 and is machine shaped into the geometry shown in FIG. 11 to follow the rear edge of panels 404 and 406. Heat exchanger panels 404 and 406 are also constructed using metal stamping technology; each consists of a bottom header 408,410 which communicates with a vertically extending header 411,413; a short top horizontal header 414,416; and a plurality of vertically extending serpentine circuits 419*a* through 419*f* and 420*a* through 420*e*. At the narrow end of the convection section heat exchanger the vertically extending serpentine circuits 419*a* through 419*e* converge into circuit 419*f* while circuits 420*a* through 420*d* converge into flow path 420*e*. The vertical flow circuit arrangement shown for panel 406 is one of several possible combinations. Panel 404 is the mirror image of panel 406.

These four heat exchanger panels 404, 405, 406 and 407 are welded at the seams to form a seal tight assembly against the products of combustion. Horizontal headers 412, 417, 409, 415, 416 and 414 are open at both ends; whereas horizontally extending headers 410 and 408 and vertically extending headers 411 and 413 are open at one of the ends. These open ended sections of the headers are required for interconnecting the flow between panels 404, 405, 406 and 407 using a stamped corner plate 424 in the configuration shown in FIG. 12 which more or less resembles a quarter section of an orange peel.

Figure 12:
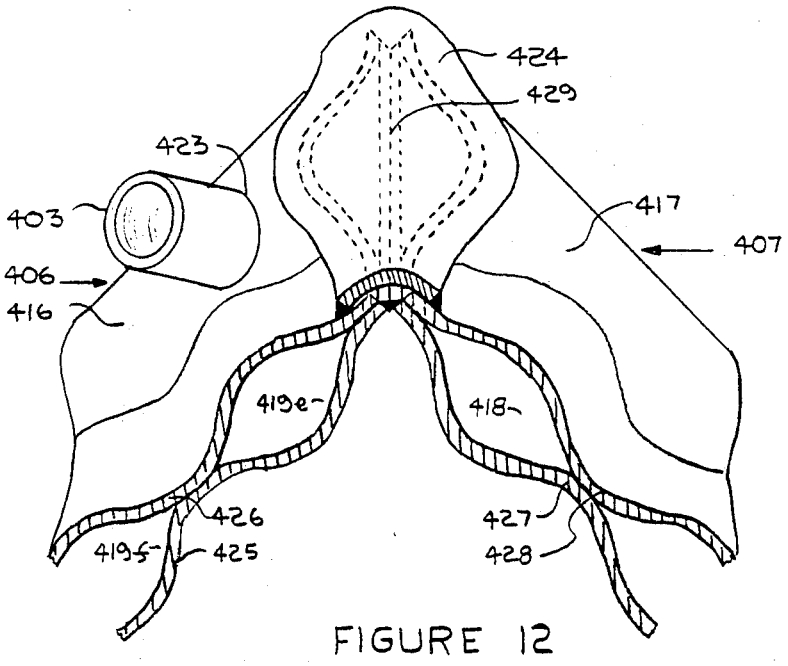
FIG. 12 is a top perspective view with parts broken away of the top left corner of the assembly shown in FIG. 11 showing how the headers may be interconnected.

In FIG. 12, a perspective view of a method of interconnecting headers 416 and 417 of panels 406 and 407 respectively is shown. As was previously described and shown in FIG. 2, the two stamped metal sheets 425 and 426 of panel 406 are juxtaposed and suitably welded in a face to face relationship to result in flow circuits 419*f*, 420*e* and header 416. In the same manner, stamped metal sheets 427 and 428 of panel 407 are juxtaposed and suitably welded to result in flow circuits 418 and header 417. In order for the panels 404, 405, 406 and 407 to "fit properly" during welding, headers 416 and 417 require that inside plates 425 and 427 be mitered along dotted line 429 (approximately 45°). This method of construction insures that the cross-sectional area at the joint is essentially the same as the cross-section of the respective headers 416 and 417 resulting in no flow restriction. The construction shown in FIG. 12 is suitable for interconnecting flow throughout assembly 400. The four heat exchanger panels 404, 405, 406 and 407 are assembled on a jig (not shown) and suitably welded all around at the seams to result in a seal tight assembly against the products of combustion. Stamped plate 424 is then fitted to each corner and suitably welded all around the edges to produce a leak proof joint and continuity of flow.

Inlet pipe 401 is shown connected to horizontal header 408 at 421. The inlet pipe 401 can be connected anywhere along the horizontally extending bottom header defined by headers 408, 409, 410, 411, 412 and 413. However, connection is preferred at the lowest point namely on headers 408, 409 or 410; thus, the inlet pipe 401 can also be used to drain the system if needed.

The bottom horizontal header contouring assembly 400 feeds the plurality of flow circuits 419*a* to 420*d* and all those of panels 404 and 405 which are used for heat exchange. The plurality of vertically extending flow circuits in turn feed into a continuous top header defined by individual headers 414, 415, 416 and 417. Outlet pipe 402 is shown connected to header 414 of panel 404 at 422. It is preferred that pipe 402 be connected at the highest point on the continuous top header to avoid air entrapment when filling the assembly with the thermal exchange fluid. An additional fitting 403 welded to header 416 at 423 is also provided for the purpose of installing such devices as thermowells, safety valves, pressure gauges, etc.

The fireplace boiler assembly 400 of FIG. 11, when compared with assembly 110 shown in FIG. 1 is more advantageous in terms of assembly time and fabrication costs. Return bends, seal plates, and end plugs are no longer required. These components are not only expensive but take up a considerable amount of time and skill to weld. Fireplace assembly 400 is intended for mass production.

Figure 13:
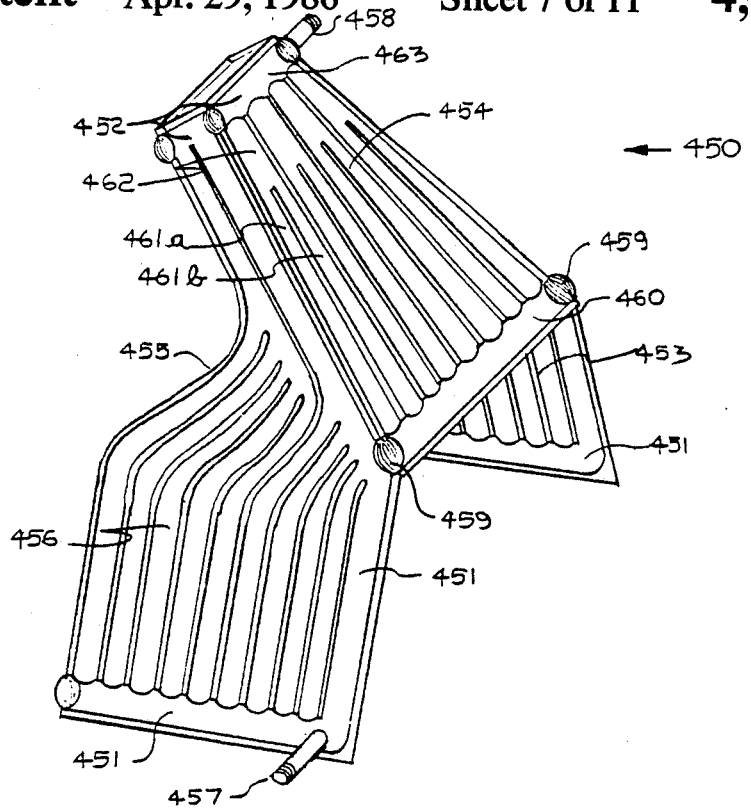
FIG. 13 is a perspective view of a variant of the embodiment shown in FIG. 11 where the convection section is tapered.

Referring now to FIG. 13, an alternate embodiment of the fireplace boiler assembly 400 of FIG. 11 as shown. Fireplace boiler assembly 450 is tapered at the convection section so that installation of the chimney may be easier. Essentially, it consists of four heat exchanger panels 453, 454, 455 and 456; a continuous horizontal bottom header 451; a continuous top header 452; a plurality of vertically extending flow circuits for heat exchange; an inlet pipe 457; an outlet pipe 458; and stamped corner plate 459 for flow interconnection between panels similar to the construction shown in FIG. 12.

Panels 454 and 455 are built in the shape of a trapezoid. The vertical flow circuits 461*a* and 461*b*, between header 460 and 463 of panel 454, converge into a single flow circuit 462 as a result of narrowing down of panel 454. Back panel 455 is more or less of the same construction as panel 454, but is longer and is shaped in the form of an "S" to outline the edges of panels 453 and 456 for welding.

Figure 14:
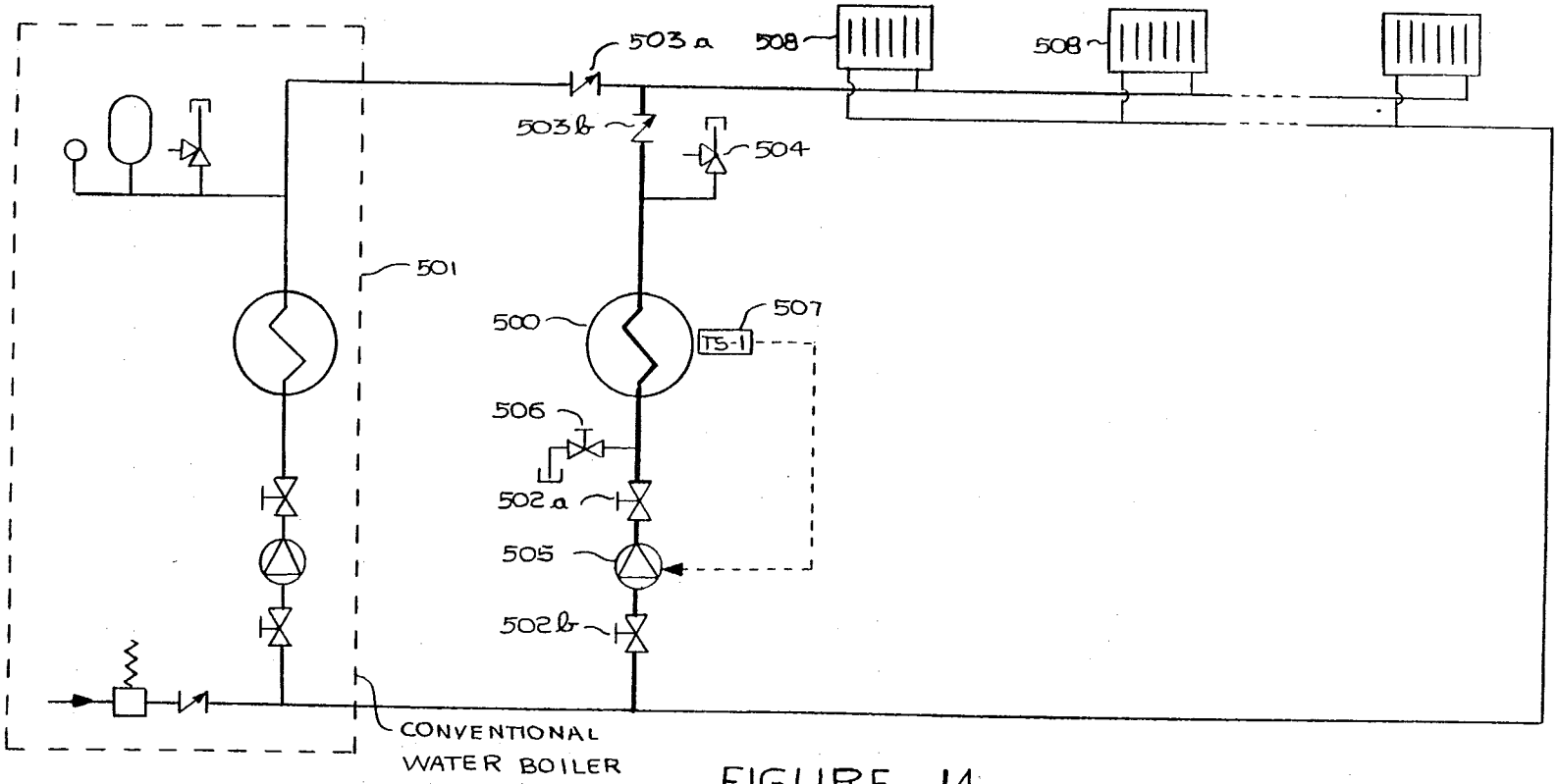
FIG. 14 is a flow circuit diagram of a heating system in accordance with this invention using a fireplace boiler assembly integrated with a central hot water system.

Referring now to FIG. 14, a flow circuit diagram of a domestic heating system is shown where the highly efficient boiler assembly 500, in accordance with the teachings of this invention, operates in parallel with a conventional hot water boiler system 501. In order to parallel properly it is necessary to add flow control devices consisting of a pressure safety valve 504, check valves 503*a* and 503*b*; circulation pump 505, shut-off gate valves 502*a* and 502*b*; drain valve 506 and thermostat 507. The two check valves 503*a* and 503*b* must be added to prevent flow recirculation between boilers 500 and 501. The two boilers 500 and 501 operate at the same pressure and use the same water for heat transfer. The safety valve 504 is normally set at the same pressure as that of the conventional boiler 501 (normally 207 kpa). Thermostat 507 senses the temperature of the water in fireplace boiler 500. It is normally installed in a thermowell or suitably clamped to the outlet pipe of boiler 500. In normal operation the heated water rises and once the set point temperature on thermostat 507 is reached (say 40° C.) it gives a signal to circulation pump 505 to start. Circulation pump 505 provides the motive power to transfer heat to pre-existing baseboards 508 which distributes the heat throughout the building.

The fireplace assembly 500 is intended as a primary source of heat for domestic purposes and the conventional heating system becomes a back-up. This is achieved by lowering the house thermostat which controls boiler package 501 to a minimum say 18° or 19° C. and then adding wood to boiler 500 to maintain the desired temperature of 21° C. The rate of combustion is controlled primarily by varying the amount of combustion air entering horizontally towards the fire, as described above.

The system shown in FIG. 14 is fully automatic. The user is required to add wood and set the amount of combustion air which depends on how cold it is outside. Circulation pump 505 is started automatically by thermostat 507. It is important to note that unlike the conventional boiler 501, the heat of combustion in a wood burning fireplace 500 can not be stopped immediately so that the air temperature in the house being heated will have a tendency of overshooting and undershooting. Should the house air temperature drop below 18° or 19° C. for whatever reason (or whatever the user sets it at) the back-up conventional boiler 501 will start automatically by the regular house thermostat. Also both boilers can be operating at the same time.

In a normal installation the fireplace boiler assembly 500 can exceed a net heat output of 31,500 kg.—calories per hour, (125,000 BTU/hr,), which is sufficient to provide all of the heat requirement of a regular duplex in the Montreal city area on the coldest winter day. This system therefore gives the user full control of his heating needs, and can become independent from conventional energy sources such as oil or natural gas. If the hydronic heating system shown in FIG. 14 is designed for natural convection heating, then the user also become independent of electricity for space heating.

Figure 15:
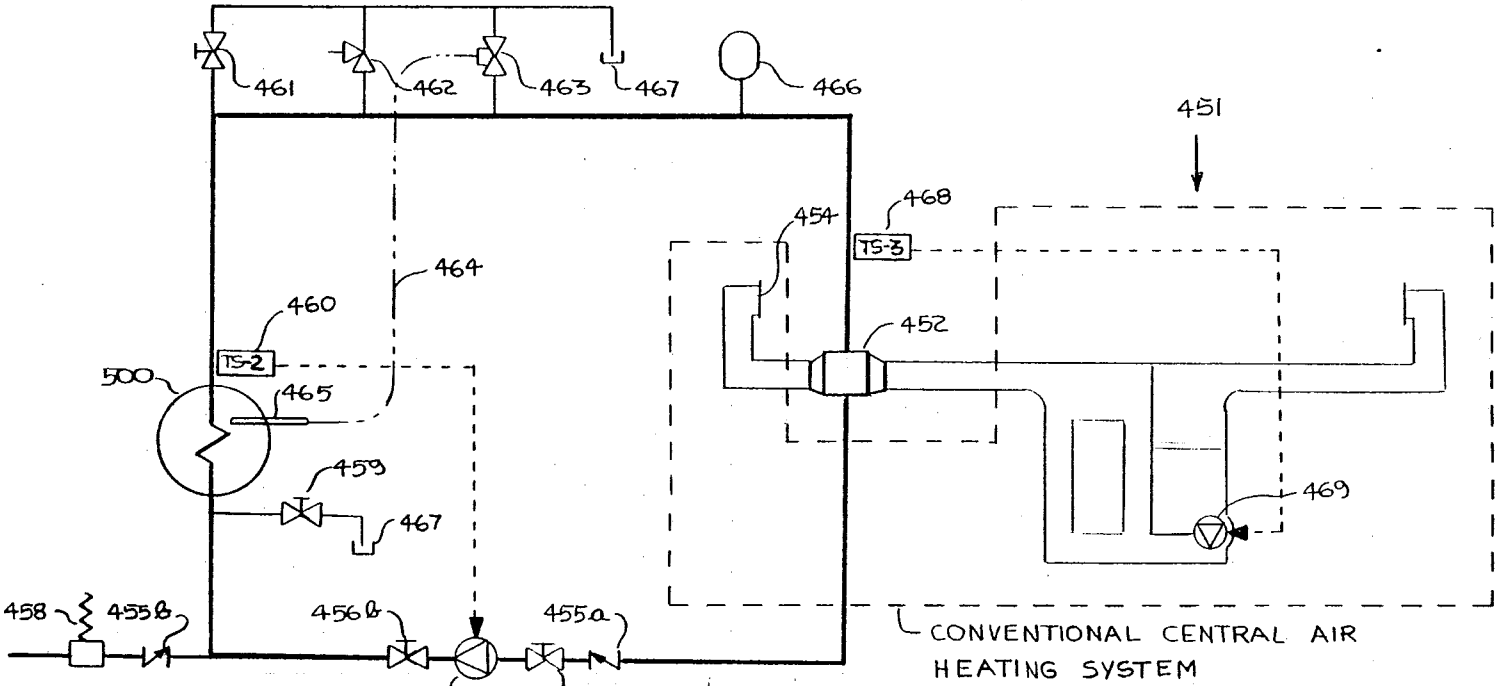
FIG. 15 is a flow circuit diagram of a heating system where the fireplace boiler assembly made in accordance with this invention is integrated with a central air heating system.

Referring now to FIG. 15, an alternate application of the fireplace boiler assembly 500, in accordance with the teachings of this invention is shown. In this application the wood heating system is integrated with a central air heating system 451 of the prior art. The water circulation loop is the "heat supply" loop and the heating system 451 is the heat recovery loop. The heating system shown in FIG. 15 consists of a standard central air heating system 451; a highly efficient fireplace boiler assembly 500; a water-to-air air heat exchanger 452; check valves 455*a* and 455*b*; pressure reducing valve 458; shut-off gate valves 456*a* and 456*b*; circulation pump 457; drain valve 459; air bleed valve 461; pressure safety relief valve 462; temperature relief valve 463; expansion tank 466 and thermostats 460 and 468.

The conventional central air system 451 is modified such that (1) a water-to-air heat exchanger 452 is inserted in the main air distribution duct leading from inlet register 453 to outlet register 454, and (2) in addition to its regular starting controls the air circulating fan 469 is rewired such that it is also started by thermostat 468 which senses circulation water temperature on the inlet of exchanger 452. Thermostat 468 is normally set in the range of 55° C. to 75° C. to start circulation fan 469. The heat exchanger 452 is of the prior art and is sized to remove maximum heat output of the fireplace boiler 500. A unit available on the market and suitable for this application is a 31,500 kg-calories/hr. water-to-air exchanger manufactured by Mark Hot Inc. of Montreal, Quebec, Canada.

The arrangement of flow control devices which equip boiler 500 is more or less similar to that used in conventional packaged hot water boilers such as shown at 501 in FIG. 14. Unlike a conventional packaged boiler, temperature control valve 463 and check valve 455*a* are required to moderate the temperature of assembly 500 by introducing cooling water during abnormal operating conditions such as loss of electric power, failure of circulation pump 457 or failure of air circulation fan 469. Under the above mentioned circumstances combustion will continue but the heat generated by the burning of fuel wood will not be transported or removed resulting in rapid temperature and pressure rises. The specifications of the Canadian Standards Association (CSA) provide that safety valves 462 are not designed for continuous relief of pressure and other devices such as the temperature control valve 463 are required. The temperature relief valve made by Honeywell Braukman Inc. and sold under the model designation No. TS-130 is suitable for this application.

The temperature control valve 463 is operated by the expansion or contraction of the liquid in temperature sensing bulb 465, the force transmitted by capillary tube 464 opens or closes valve 463. Bulb 465 is in contact with the water in fireplace boiler assembly 500. On temperature rise, the liquid in sensing bulb 465 expands causing valve 463 to open and release hot water to drain 467. Temperature control valve 463 releases water from 112° C. and above, and recloses at 100° C. Whatever the quantity of water lost to drain 467 is made up by the domestic water supply which in turn cools boiler 500. The purpose of check valve 455*a* is to prevent the cooling water from bypassing boiler 500.

The domestic heating system shown in FIG. 15 is intended as a primary source of thermal heat. The user is required only to add fuel wood and control the rate of combustion based on previous experience and the rest is automatic. Thermostat 460 automatically starts circulation pump 457 when the temperature at the outlet of boiler 500 reaches approximately 55° C. When the appropriate water circulation loop temperature is reached, thermostat 468 automatically starts circulation fan 469 to distribute the heat throughout the building. The building thermostat 468 would normally be set between 18° and 19° C. The objective is then to maintain building temperature at around 21° C. by controlling the fuel wood loaded and its rate of combustion. Should inside temperature fall below 18° or 19° C. for whatever reason the conventional boiler 451 will automatically cut in as the back-up system. It has been determined that both boilers 500 and 451 can operate simultaneously without problem.

Figure 16:
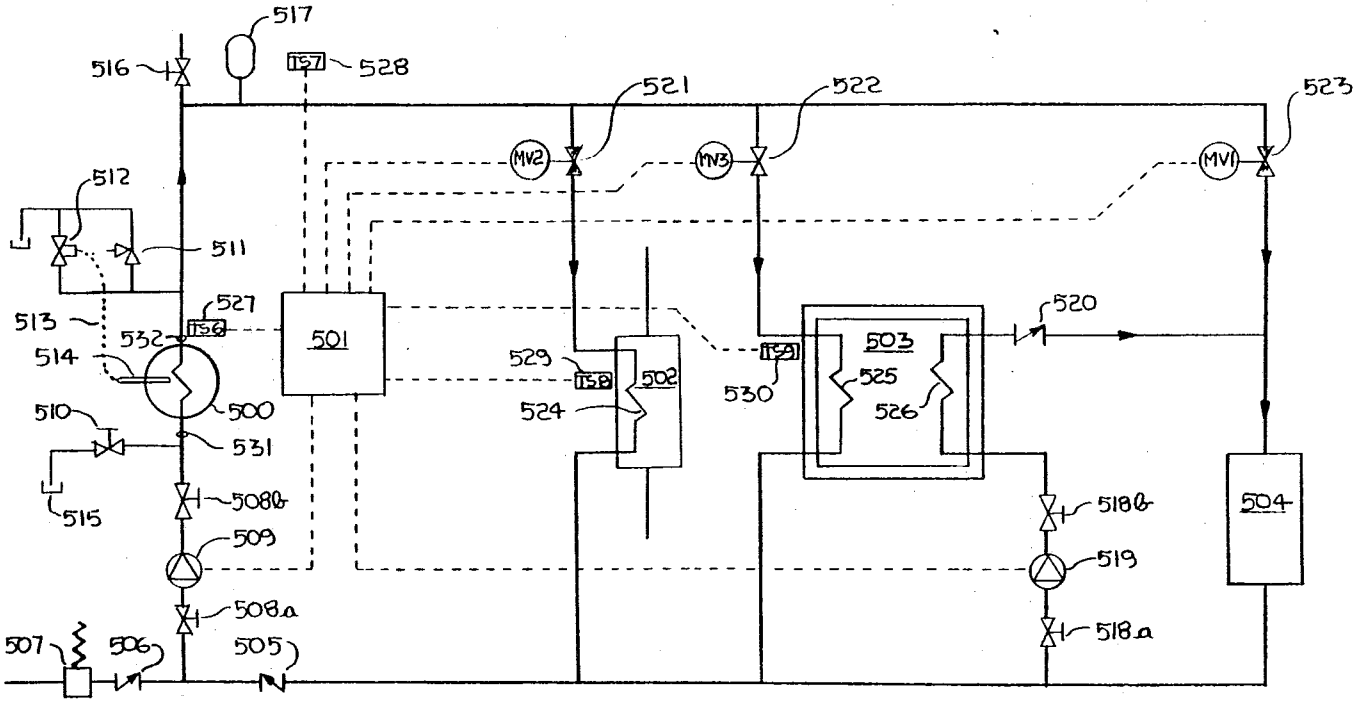
FIG. 16 is a flow circuit diagram of a heating system using a fireplace boiler assembly made in accordance with this invention and which provides all of the thermal energy needed for domestic water and space heating.

FIG. 16 is a flow circuit diagram of an integrated domestic heating system wherein the fireplace assembly 500, made in accordance with this invention, provides all of the thermal energy needed for hot water and space heating. The integrated heating system consists of a fireplace boiler 500 in accordance with the teachings of the present invention; a heat sink 503; a heat recovery system 504; a hot water tank 502; an electrical control panel 501; and a plurality of flow control devices. The flow control devices consist of a first pump 509; gate valves 508*a* and 508*b*; pressure reducing valve 507; check valves 505, 506 and 520; drain valve 510 (whose drain is shown at 515); over-pressure safety valve 511; temperature control valve 512 comprised of a liquid filled bulb 514 and capillary tube 513; an air bleed valve 516; expansion tank 517; normally closed motorized valves 521 and 523, normally open motorized valve 522; shut-off gate valves 518*a* and 518*b*; a second pump 519, and thermostats 527, 528, 529 and 530. The flow control devices pertaining to the fireplace boiler 500 are similar to those shown in FIG. 15 and perform the same function.

The heating system shown in FIG. 16 basically defines four flow circulation loops; a first heat supply loop between fireplace boiler 500 and heat recovery system 504; a second heat supply loop between fireplace boiler 500 and hot water tank 502; a third heat supply loop between fireplace boiler 500 and heat sink 503; and a fourth heat recovery loop between heat sink 503 and heat recovery system 504.

The first heat supply loop is between the fireplace boiler 500 and the heat recovery system 504. The purpose of this loop is to provide building heat directly whenever the fireplace is operational. The first heat supply loop is from outlet pipe 532 leading into normally closed motorized valve 523 having electrical contacts MV-1*a* normally closed and MV-1*b* normally open; to heat recovery system 504; to check valve 505; to gate valve 508*a*; to a first circulation pump 509 and to gate valve 508*b* leading into inlet 531 of fireplace place boiler 500. The heat recovery system 504 may be radiators, a central air system, unit heaters or any acceptable means of distribution of heat in a building.

Figure 17:
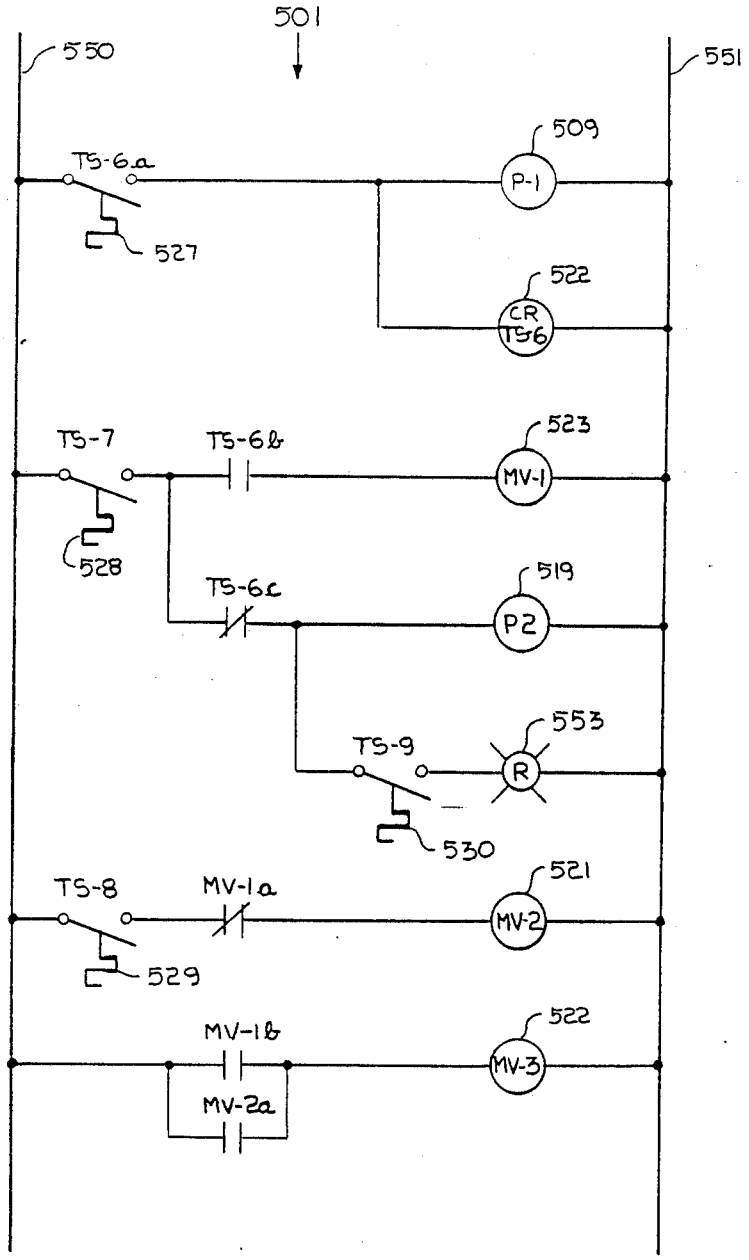
FIG. 17 is an electrical circuit diagram of the heating system shown in FIG. 16, and FIG. 18, (on the sheet of FIG. 13) is a partial perspective view of an alternate method of embossing a heat exchanger panel using spots as opposed to linear lands.

FIG. 17 is the electrical circuit diagram of the heating system shown in FIG. 16 which is represented by control panel 501. The electrical symbols generally follow the standards set by the Instrument Society of America. Thermostat 527 having a normally open contact TS-6*a* senses the temperature of the fireplace boiler 500 on outlet pipe 532 or in a thermowell (not shown). On temperature rise, contact TS-6*a* "makes" thus applying power, as represented by leads 550 and 551, to the winding of circulation pump 509 and auxiliary contacts TS-6*b* "make" as contacts TS-6*c* "break". Circulation pump 509 and auxiliary relay 552 are always energized whenever the fireplace 500 is operational. If the building requires heating, as sensed by thermostat 528, its respective contacts TS-7 in series with contacts TS-6*b*, "make" causing valve 523 to open thereby establishing circulation. Also, upon opening motorized valve 523, its normally closed auxiliary contacts MV-1*a* "break" causing motorized valve 521 to close (if not already closed) and its normally open auxiliary contacts MV-1*b* to "make" causing normally open motorized valve 552 to close. This electrical sequence establishes the first heat supply circulation loop between the fireplace boiler 500 and the heat recovery system 504. Check valve 520 is used to block the flow of water into heat exchanger 526 of heat sink 503.

The second heat supply loop is between the fireplace boiler 500 and the hot water tank 502. The purpose of second heat supply loop is to provide hot water heating needs only after the building space heating requirements, as sensed by thermostat 528, is satisfied. The hot water tank 502 is equipped with a tube-and-shell or water-to-water serpentine heat exchanger 524 and a water temperature sensing thermostat 529 having a normally closed electrical contact TS-8. The second heat supply loop is from outlet pipe 532 leading into normally closed motorized valve 521 having a normally open electrical contact MV-2*a*; to heat exchanger 524 in water tank 502; to check valve 505; to gate valve 508*a*; to first circulation pump 509 and to gate valve 508*b* leading into inlet 531 of fireplace boiler 500. When the first circulation loop is satisfied, motorized valve 523 closes causing its respective auxiliary contact MV-1*a* to revert to its normally closed position and MV-1*b* to its normally open position. If hot water is now required electrical contact TS-8, in series with MV-1*a*, energizes the normally closed valve 521 causing it to open. Upon opening valve 521 its auxiliary contact MV-2*a* energizes normally open motorized valve 522 causing it to close. Thus, a second heat supply circulation loop is established between the fireplace boiler 500 and hot water tank 502. The second heat supply circulation loop continues until the appropriate hot water temperature (approximately 65° C.) is reached as sensed by thermostat 529 or if the building requires heat in which case the first heat supply loop takes precedence. If neither space heating nor hot water is required, the third heat supply circulation loop is automatically established. The third heat supply loop is between the fireplace boiler 500 and the heat sink 503. The third loop has last priority over the first and second loop. The purpose of the third loop is to remove the heat of combustion from fireplace boiler 500 and store the thermal energy for later use by raising the temperature of a large capacity heat sink 503. The heat sink 503 may take the form of a large water reservoir of sufficient capacity to store enough thermal energy for many hours during cold periods. The heat sink consists of two serpentine water-to-water heat exchangers 525 and 526 preferably made out of copper metal and a temperature sensing thermostat 530 having a normally open electrical contact TS-9. The third heat supply loop is from outlet pipe 532 leading into normally open motorized valve 522 to a serpentine heat exchanger 503 in the large capacity heat sink 503; to check valve 505; to shut-off gate valve 508*a;* to a first circulation pump 509; to shut-off gate valve 508*b* leading into inlet 531 of fireplace boiler 500. Motorized valve 522 is always open unless hot water or space heating is required.

The fourth circulation loop is between the heat sink 503 and the heat recovery system 504. The purpose of this loop is to recover the stored heat in sink 503 for building or home heating only when the fireplace boiler 500 is not operational. The heat recovery loop consists of a serpentine water-to-water heat exchanger 526 in heat sink 503; a check valve 520; a heat recovery system 504; a shut-off gate valve 518*a;* a second circulation pump 519; and a gate valve 518*b*. If the fireplace boiler is not operational and the building thermostat 528 calls for heat, contact TS-7 in series with TS-6*c* "makes", causing circulation pump 519 to start. Valve 523 is a normally closed valve and it will remain closed upon establishing the fourth heat recovery loop between the fireplace boiler 500 and the heat recovery system 504. Also in control panel 501 is a pilot light 553 which is used to indicate that the temperature of the heat sink 503 is low requiring more heat storage. Thermostat 530, having an electrical contact TS-9, senses the heat sink water temperature. On too low a sink temperature, contact TS-9 in series with TS-6*c* and TS-7 "makes", energizing pilot light 553.

The heat recovery system 504 may also be a conventional hot water boiler or a central air furnace system. In this case, the heating system shown in FIG. 16 can also parallel with the conventional heating systems more or less in the same manner shown in FIG. 14 and FIG. 15. An auxiliary relay can be paralleled with pilot light 553 and which may be used to automatically restart the conventional heating system on low heat sink temperature.

I used heat exchanger elements made of carbon steel on account of the general availability of this metal in sheet form and in corrugated stamped panels, but the term steel as used in the present disclosure and in the appended claims is intended to cover all suitable steel materials including stainless steel. My invention extends not only to heat exchanger elements wherein the embossing of the sheet metal is effected prior to assembly and welding of the two walls thereof, but also to those elements wherein embossing of the walls is effected after welding such as by injecting under high pressure a liquid between the two seam welded sheet metal walls to cause plastic outward bulging of the regions of the walls between the seams. Likewise, spot welding may be resorted to for welding together the two sheet metal walls of the heat exchanger elements inwardly of their periphery when their embossing consists of spots as opposed to linear lands.

Figure 18:
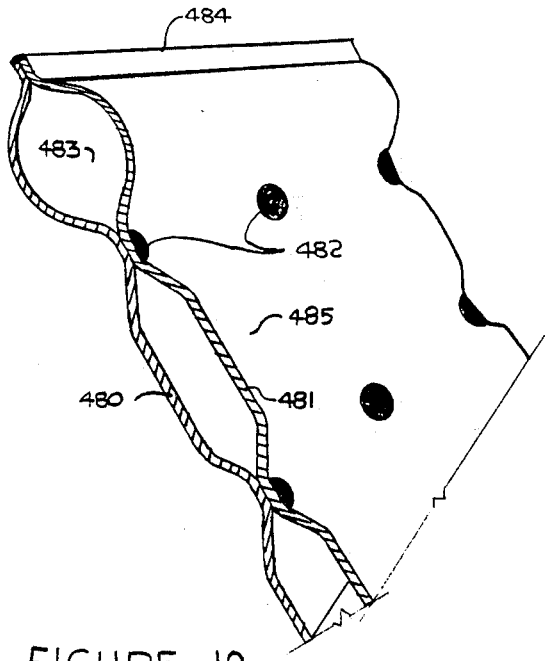

With particular reference to FIG. 18, a partial perspective view of an alternate method of embossing a panel heat exchanger is shown. The panel consists of an inner wall 480 and an outer wall 481 which are coextensive and parallel to one another. The sheet metal stampings 480 and 481 are juxtaposed and welded together along their periphery 484 (except at the headers) and inwardly of their periphery at regularly spaced spots or "dimples" 482. The embossed inner wall 480 and outer wall 481 also defines a bottom horizontal header (not shown) and a top horizontal header 483 in communication with a vertically extending "dimpled" exchanger surface 485. This construction resembles a parallel plate heat exchanger where the plates are held together by steel spacer pins welded at both ends to the plates at regularly spaced invervals. Unlike the parallel plate heat exchanger, the spacer pins are replaced by stamped "dimples" and subsequently spot welded. The construction shown in FIG. 18 results in a different manufacturing process when compared to FIG. 2 even though the materials, metal thickness and operating pressures are similar. The serpentine flow circuits used for the assembly shown in FIGS. 11 and 13 are not required since the water in the "dimpled" surface panel heat exchanger is a flow conducting relationship throughout its extent (except at the spot welds.)

The invention has been described with reference to several preferred embodiments thereof; but it is to be understood that variations and modifications can be affected within the spirit and scope of the invention.

I claim:

1. A fireplace hot water boiler comprising a plurality of heat exchange elements suitably coupled together for circulating a liquid such as water therethrough and juxtaposed to define a totally enclosing, free-standing structure defining a radiant section heat exchanger in which a fire is located, an outlet in a top of said radiant section heat exchanger through which all of the combustion gases pass, and a convection section heat exchanger connected to said outlet and through which the combustion gases pass, each heat exchanger element comprising an inner wall, a coextensive and generally parallel outer wall peripherally welded to said inner wall, and duct means for the water circulating thorugh the space defined between said inner and outer walls, the inner and outer walls of each heat exchanger element being made of gauge sheet metal of steel at least one of which being configured by embossing, stamping or otherwise with a pluraity of regularly and generally vertically distributed contact regions where said inner and outer walls contact one another and are welded together to provide generally vertical water flow paths between consecutive contact regions, each heat exchanger element being designed and constructed to withstand the working pressure of domestic pressurized hot water heating systems and the thermal stresses of wood burning, said fireplace hot water boiler further comprising pipe means for suitable connected with a hot water heat load.

2. A fireplace hot water boiler as defined in claim 1 wherein said radiant section heat exchanger comprises a lower back panel and two lower lateral panels each of which being defined by a different one of said heat exchanger elements, wherein said convection section heat exchanger comprises an upper front panel, an upper back panel spaced from said upper front panel and two spaced apart sides cooperating with said upper front panel and with said upper back panel to define a smoke chamber, each of said upper front panel and of said upper back panel being defined by a different one of said heat exchanger elements and wherein said water flow paths define, in each heat exchanger element, a plurality of upright water flow paths interconnected at their opposite ends by a lower manifold flow path and by an upper manifold flow path, said fireplace hot water boiler also being a gas-tight structure between the fireplace opening and the chimney.

3. A fireplace hot water boiler as defined in claim 2 wherein said upper back panel is made of two contiguous heat exchanger elements serially connected together and disposed one above the other, the lower one extending upwardly and forwardly from the upper edge of said lower back panel, and the upper one of said last mentioned head exchanging elements extending upwardly and rearwardly generally parallel to said upper front panel, wherein the lower manifold flow paths of said radiant section heat exchanger are serially connected together, and wherein said radiant section heat exchanger comprises a rectangular frame of steel defining the fireplace opening of said fireplace boiler.

4. A fireplace hot water boiler as defined in claim 1 wherein said radiant section heat exchanger and said convection section heat exchanger are formed by a single heat exchanging assembly comprising four heat exchanger elements welded together, namely two side panels, an upper front panel inclined rearwardly, and a back panel cooperating with said side panels and said upper front panel to form a gas-tight smoke chamber leading from the radiant section heat exchanger to the chimney of said fireplace and wherein the water flow paths of each side panel extend upwardly and merge into one another in the upper, narrower region of said side panel.

5. A fireplace hot water boiler as defined in claim 4 wherein said back panel comprises a lower region which is essentially planar and vertical, an upper region which is essentially planar and rearwardly inclined in the upward direction and a curved intermediate region which extends essentially upwardly and forwardly between said lower and upper regions, wherein said upper front panel is planar and essentially parallel to the upper region of said back panel and wherein said front panel is trapezoid in plan view.

* * * * *